US008978266B2

(12) United States Patent
Williams

(10) Patent No.: US 8,978,266 B2
(45) Date of Patent: Mar. 17, 2015

(54) PORTABLE SKATE/BOOT/GLOVE DRYER

(75) Inventor: Gary Williams, Langley (CA)

(73) Assignee: Williams Boot & Glove Dryers Inc., Langley, BC (CA)

( * ) Notice: Subject to any disclaimer, the term of this patent is extended or adjusted under 35 U.S.C. 154(b) by 695 days.

(21) Appl. No.: 13/267,958

(22) Filed: Oct. 7, 2011

(65) Prior Publication Data

US 2013/0086811 A1 Apr. 11, 2013

(51) Int. Cl.

| | |
|---|---|
| ***F26B 21/00*** | (2006.01) |
| ***A47F 7/08*** | (2006.01) |
| ***A47L 23/20*** | (2006.01) |
| ***A63C 3/00*** | (2006.01) |
| *A47F 5/13* | (2006.01) |
| *F26B 9/00* | (2006.01) |

(52) U.S. Cl.

CPC ..... *A47L 23/205* (2013.01); *A47F 7/08* (2013.01); *A47F 5/13* (2013.01); *F26B 9/003* (2013.01); *F26B 21/006* (2013.01); *A63C 3/00* (2013.01); *A63C 2203/12* (2013.01); *A63C 2203/44* (2013.01)

USPC ..... 34/104

(58) Field of Classification Search

CPC ..... A47L 23/20; A47L 23/205; D06F 59/00; D06F 59/04; D06F 59/06; F26B 9/003; F26B 21/006

USPC ..... 34/103, 104, 106, 440, 442, 437; D32/58, 59; 211/34, 36, 37, 38, 41.5, 211/41.6

See application file for complete search history.

(56) References Cited

U.S. PATENT DOCUMENTS

| | | | | |
|---|---|---|---|---|
| 4,677,714 | A * | 7/1987 | Wright | 411/554 |
| 5,199,188 | A * | 4/1993 | Franz | 34/105 |
| 5,222,308 | A * | 6/1993 | Barker et al. | 34/104 |
| 5,412,928 | A * | 5/1995 | Reithel | 34/104 |
| 6,796,053 | B2 * | 9/2004 | Lurie | 34/104 |
| 6,848,695 | B2 * | 2/2005 | Panasewicz et al. | 280/33.998 |
| 7,299,614 | B2 * | 11/2007 | Sanders | 56/400.01 |
| 2010/0252059 | A1 * | 10/2010 | Peverini | 132/120 |

* cited by examiner

*Primary Examiner* — David J Laux
(74) *Attorney, Agent, or Firm* — Fay Sharpe LLP

(57) ABSTRACT

A portable dryer for in situ drying multiple pairs of relatively small articles of apparel having a blower and heater for forcing air into a pair of attached oppositely directed manifolds, each with discharge ports and adjacent support members for the articles to be dried. One of the manifolds is attached by a quick-release slotted connection for assembly and removal without tools. In preparation for transport, the user removes, inverts and stacks the one manifold on the opposite manifold reducing the volume of bag or enclosure required for one person transport.

7 Claims, 10 Drawing Sheets

PORTABLE SKATE/BOOT/GLOVE DRYER

BACKGROUND

The present disclosure relates to forced air dryers of the type employed for drying skates, boots and gloves, or other relatively small articles of apparel where it is required to dry multiple pairs of such articles of apparel on site where the articles are being worn by the user. In particular, it has been desired to provide a portable dryer which can be readily carried by one person and utilized on site as, for example, hockey or ski teams travelling progressively to different locations on an overnight itinerary.

Heretofore, portable dryers available for skates, boots and gloves and the like have been of the type designed for drying an individual pair of such items and, thus, a multiple number of dryers was required to dry a number of such items; or, if only a single dryer was available, for the items to be dried serially.

Thus, it has been desired to provide a convenient, lightweight and readily transportable forced air dryer for drying a multiple number of pairs of articles such as skates, boots and gloves which can be readily transported by one person.

SUMMARY

The present disclosure describes a portable forced air dryer which is capable of drying multiple pairs of articles such as skates, boots or gloves and the like on a pair of oppositely directed air discharge manifolds, each with a plurality of spaced air discharge ports and having an article support member associated with each air discharge port. One of the manifolds is assembled to a blower discharge plenum with a quick-release connection that is operable to maintain the manifold inlet port in connection with discharge ports on the plenum.

The disclosed and illustrated version shows the releasable manifold attached to the plenum by brackets having open slots permitting assembly without tools for engaging lugs on the plenum. Inclined or cam surfaces are provided in the slots for causing the weight of the manifolds to urge the manifold into contact with the plenum for communication of the manifold inlet with the plenum discharge ports.

In preparation for transport, the one plenum may be quickly released by the user without any tools and may be inverted and assembled over the opposite manifold to minimize the volume of the dryer for bagging or placement in a transport enclosure to permit portability by one person to locations for drying multiple pairs of articles in situ by the users. The removal and inverted stacking of the one manifold onto the other manifold substantially reduces the volume of the blower to enable transport by a single person.

DETAILED DESCRIPTION

Figure 1:
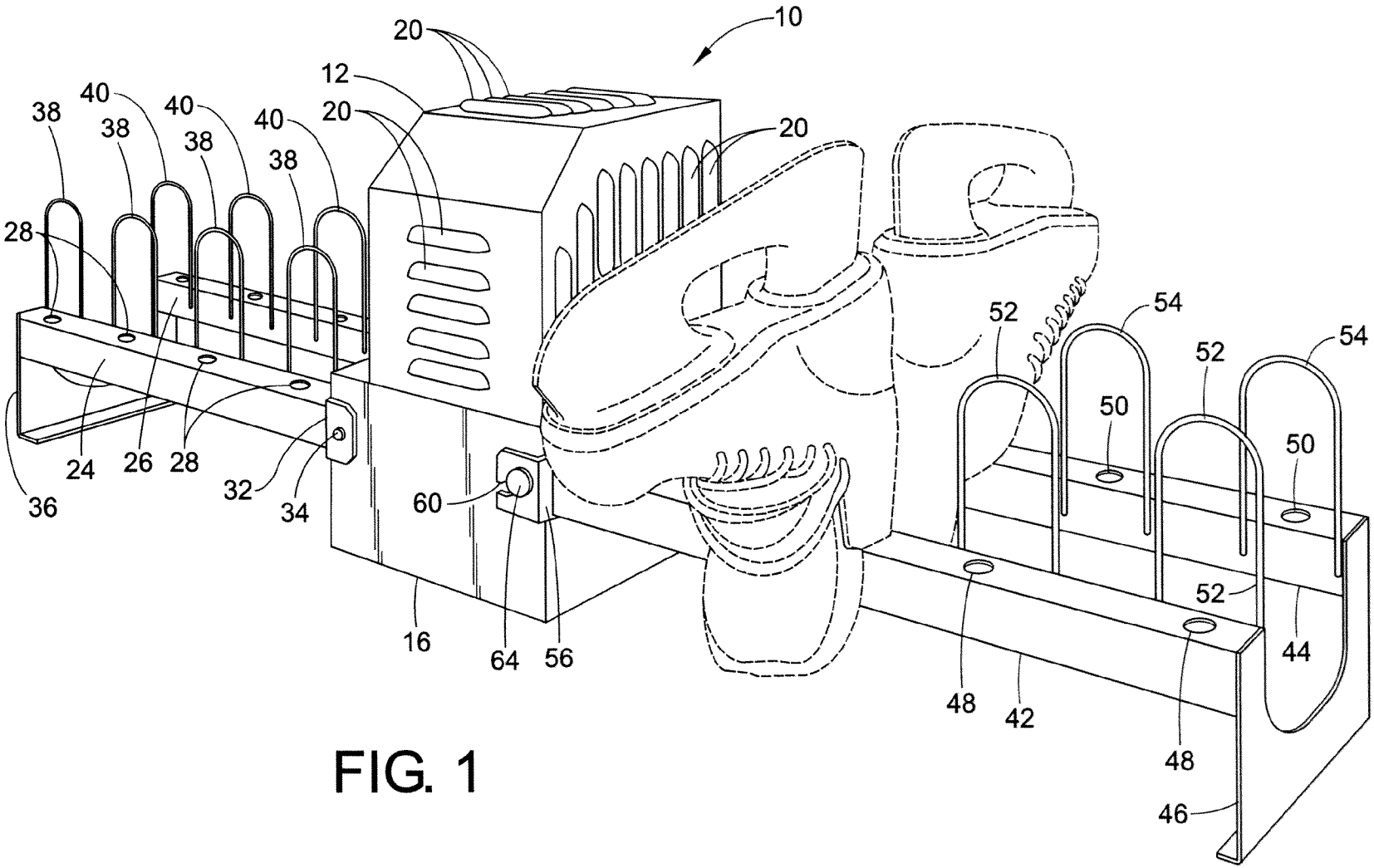
FIG. 1 is a perspective view of the dryer assembly of the present disclosure.
Figure 2:
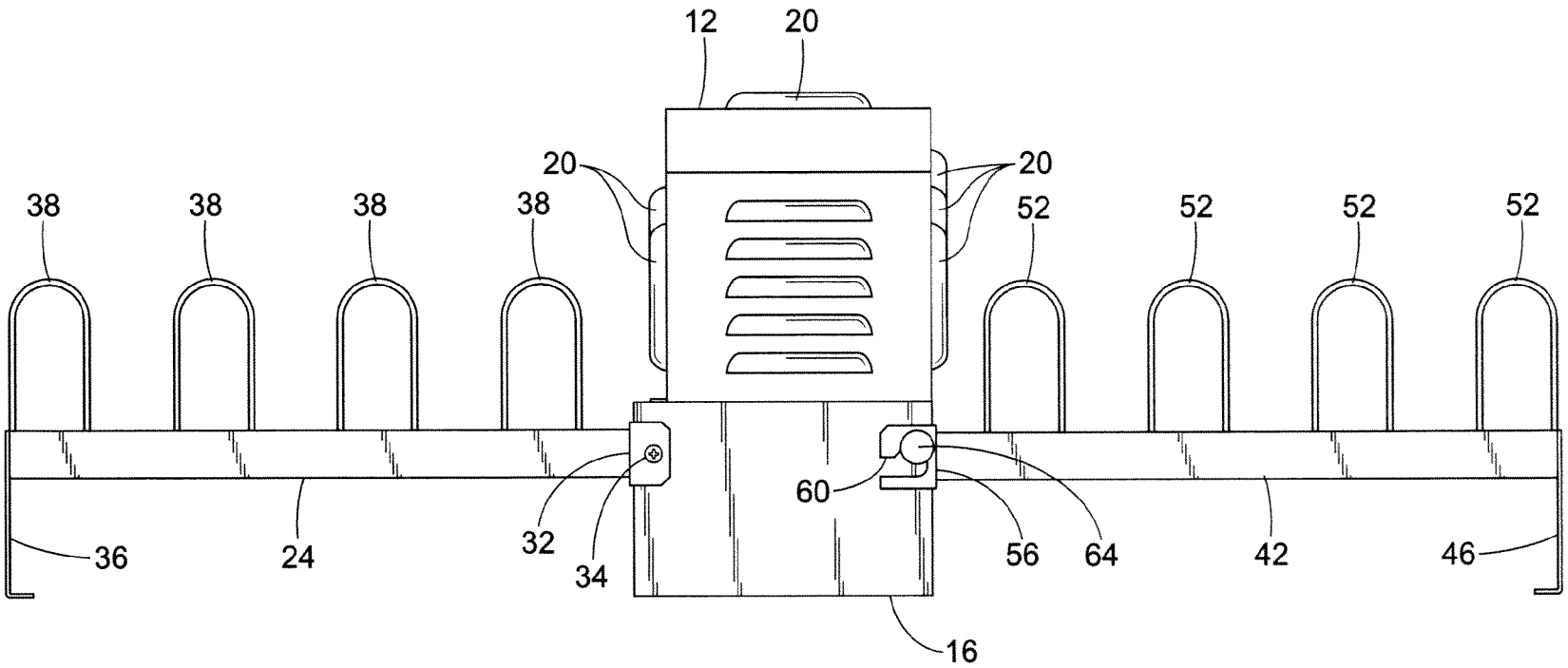
FIG. 2 is a front elevation view of the dryer of FIG. 1.
Figure 3:
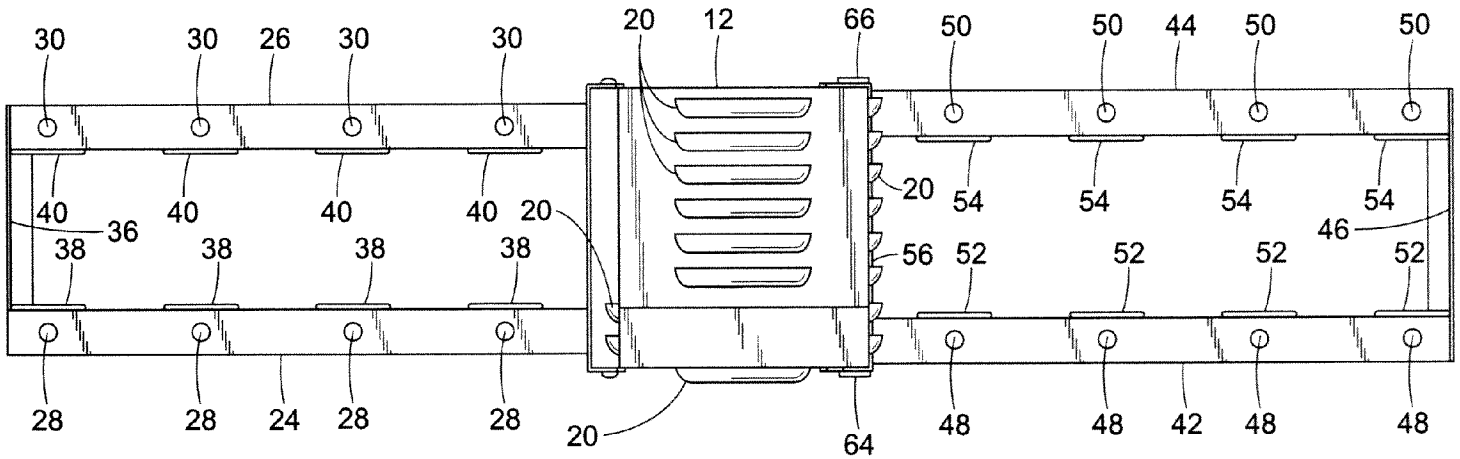
FIG. 3 is a top view of the dryer of FIG. 1.
Figure 4:
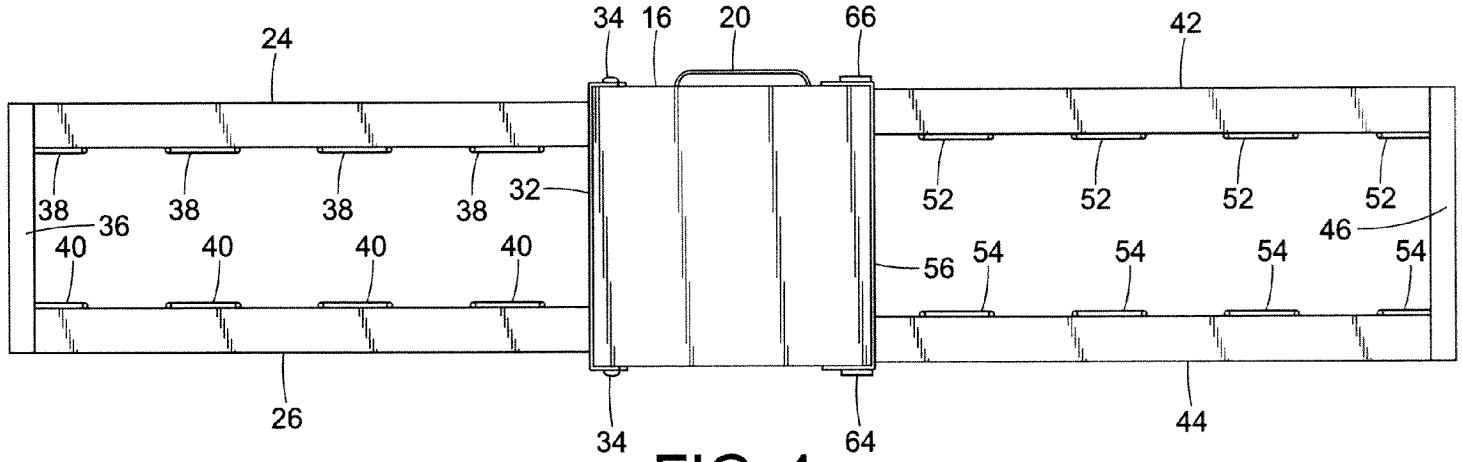
FIG. 4 is a bottom view of the dryer of FIG. 1.
Figure 6:
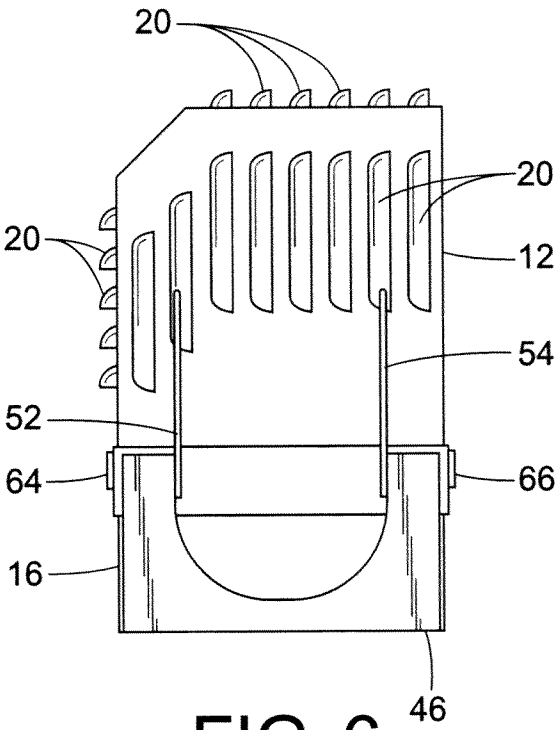
FIG. 6 is a right end elevation view of the dryer of FIG. 1.
Figure 5:
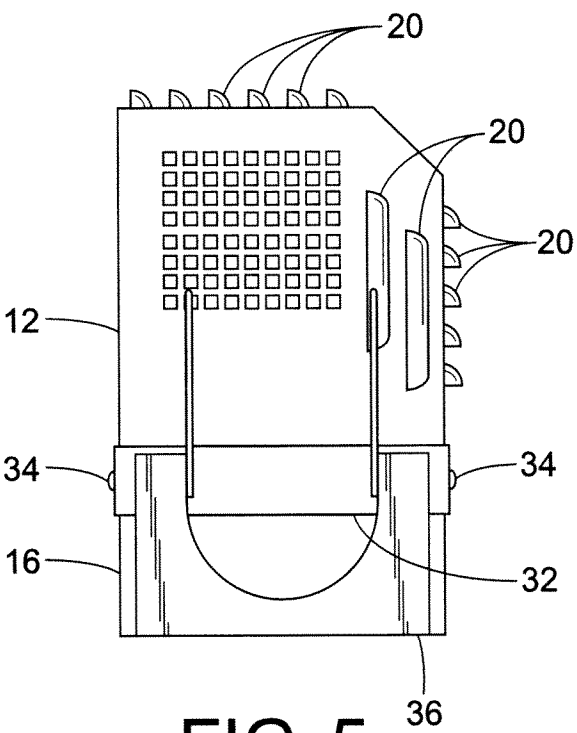
FIG. 5 is a left end elevation view of the dryer of FIG. 1.
Figure 7:
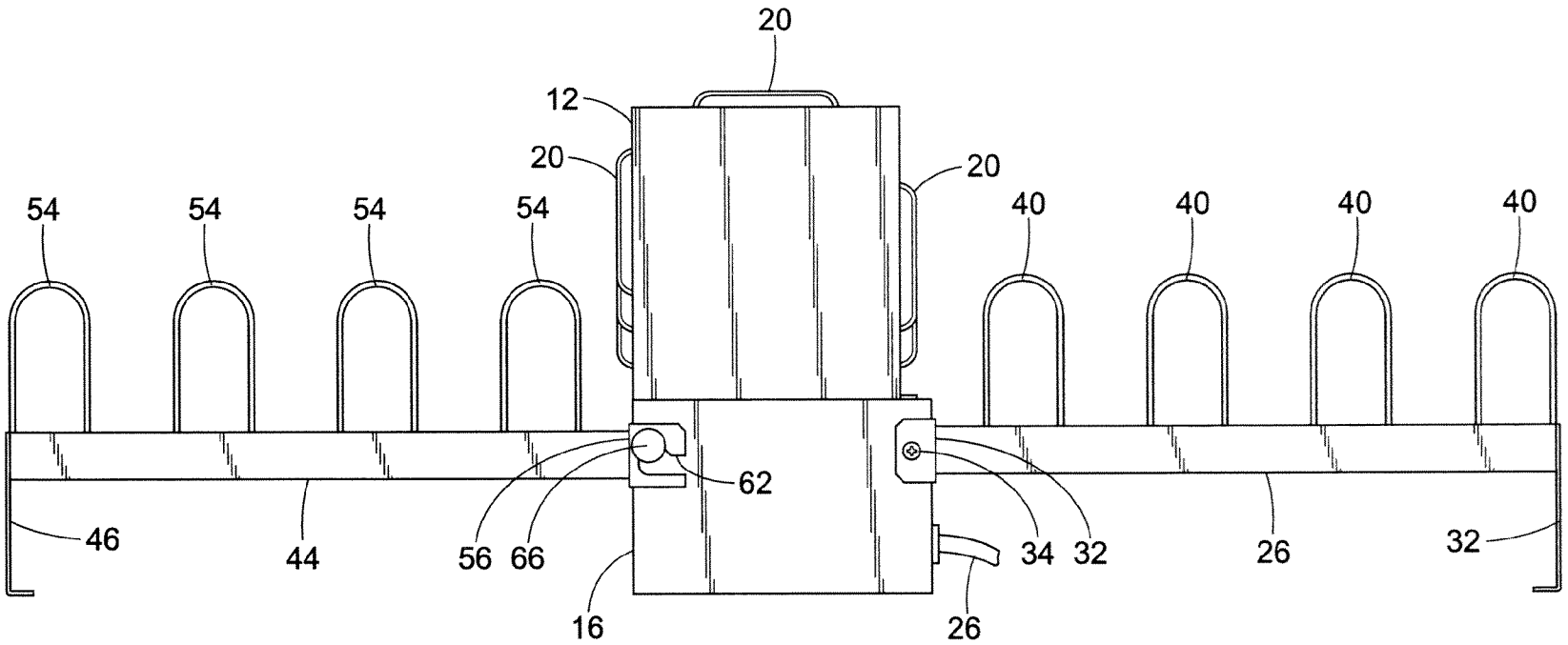
FIG. 7 is a rear elevation view of the dryer of FIG. 1.

Referring to FIG. 1, the assembled dryer of the present disclosure is indicated generally at 10 and has a blower housing 12 which contains a motorized blower 14 (see FIGS. 10 and 11) which is mounted on a plenum housing 16 such that the blower 14 discharges air into the plenum chamber within housing 16. The blower housing 12 includes a plurality of louvers 20 which provide for air intake to the blower 14.

Figure 10:
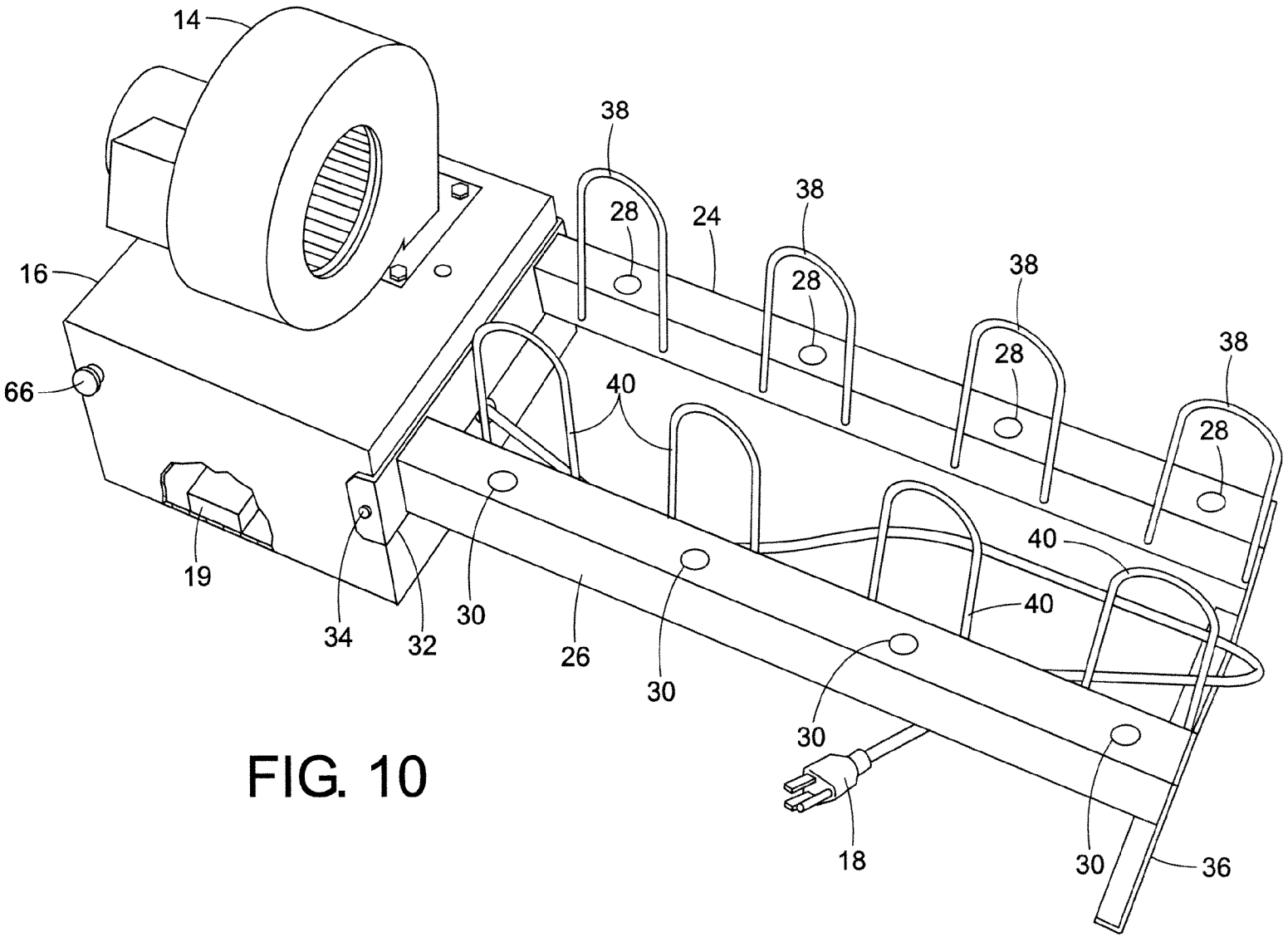
FIG. 10 is a perspective view of the dryer of FIG. 1 with the blower housing and quick-release manifold removed, with a portion of the plenum housing broken away to show the heater.
Figure 11:
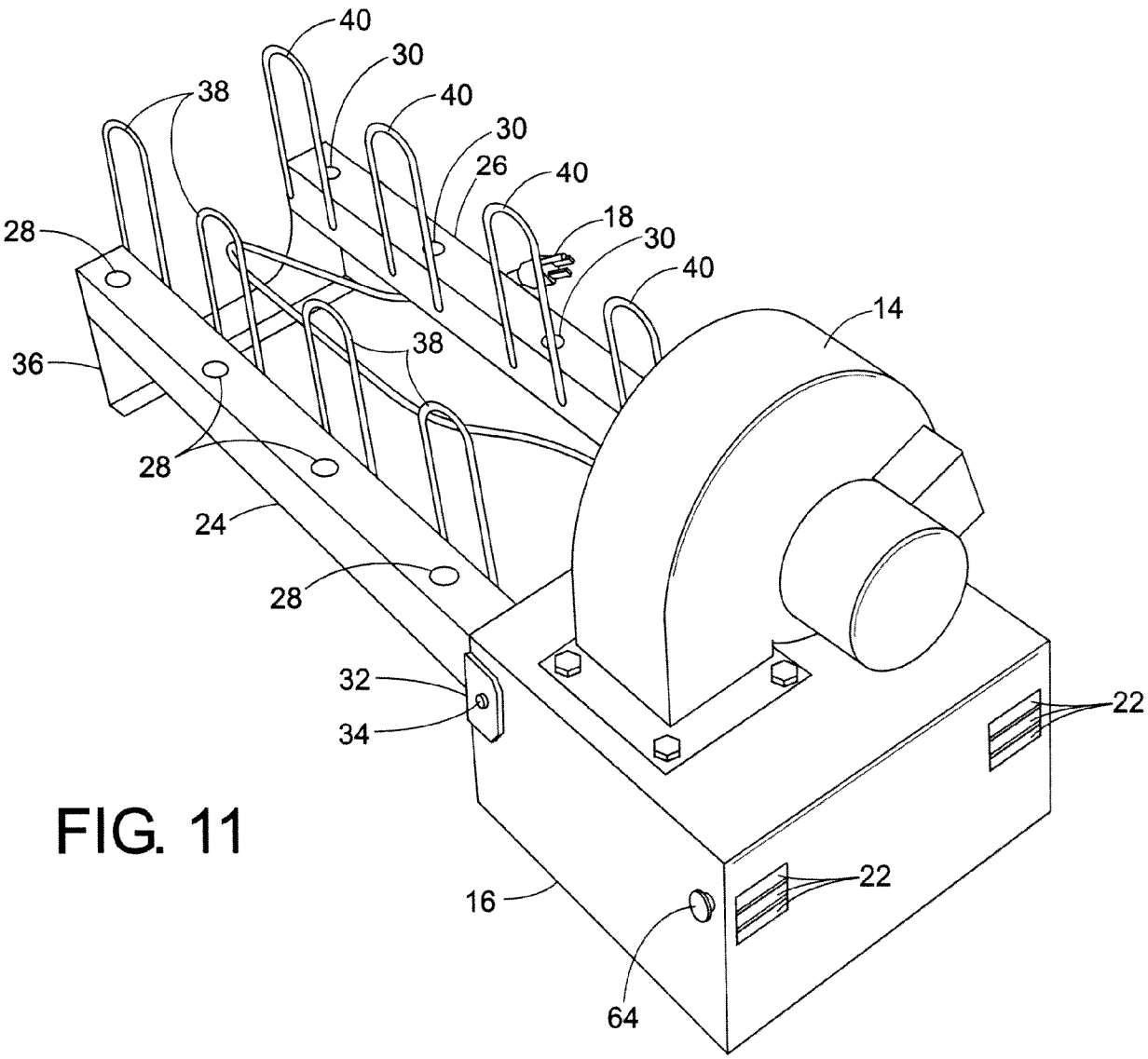
FIG. 11 is a view similar to FIG. 10 from the opposite end illustrating the plenum housing discharge ports; and, FIG. 12 is a perspective view of the dryer of FIG. 1 with the quick-release manifold removed, inverted and stacked on the opposite manifold in preparation for transport.

If desired, the plenum housing 16 may contain a heating element 19 (see FIG. 10) which, along with the blower 14, is connectable to a source of electrical power by power lead 18 also shown in FIGS. 10 and 11.

Referring to FIG. 11, the plenum housing 16 has on opposite sides thereof, a plurality of air discharge ports 22 located thereon so as to provide forced air to the manifolds as will hereinafter be described. It will be understood that although the discharge ports 22 are shown on one side of the plenum housing 16 in FIG. 11 that a similar set of discharge ports is provided on the opposite side of the plenum housing 16.

Referring to FIGS. 1-7, 10 and 11, a pair of fixed discharge manifolds 24, 26 are disposed to extend outwardly from the distal side of the plenum housing 16 in FIG. 1 and the left side of housing 16 in FIGS. 2-4, 7 and 11 and the right side in FIG. 10. The pair of manifolds each having a plurality of forced air discharge ports 28, 30 provided respectively thereon in spaced arrangement. The proximal ends of the manifolds 24, 26 are attached to a generally U-shaped bracket 32 such as for, example, by weldment, with the bracket 32 having the opposite sides thereof secured to the plenum housing 16 by suitable fasteners such as screws 34.

The distal ends of the manifolds 24, 26 are closed and secured, such as by weldment, to a support bracket 36.

Adjacent each of the manifold discharge ports 28, 30 is a support member denoted respectfully 38, 40 for supporting articles to be dried such as shoes, boots or gloves, one of which is shown in dashed outline in FIG. 1. In the present practice, members 38, 40 comprise inverted U-shaped rods or bars having the open ends thereof secured to the manifolds 24, 26, for example by weldment, such that one of the rods 38, 40 extends vertically upward adjacent each of the discharge ports 28, 30.

It will be understood that the proximal side of the plenum housing 16 in FIG. 10 has a pair of spaced discharge air outlets (not shown) but which are similar in configuration and spacing to the plenum discharge outlets 22 shown in FIG. 11 for the opposite side of the plenum housing. It will be further understood that each of the brackets 32 has apertures therein (not shown) located to receive the plenum discharge air through the outlet ports thereby permitting the discharge air to enter the interior of the manifolds 24, 26.

Referring to FIGS. 1-9 and 11, a second pair of spaced drying manifolds 42, 44 are disposed to receive forced air from the plenum housing discharge ports 22 and extend outwardly therefrom in generally spaced parallel arrangement; and, the manifolds 42, 44 are releasably connected or attached to the plenum housing 16 in a manner permitting quick-release by the user. The outer ends of manifolds 42, 44 are connected to, such as by weldment, closed by, and supported by a bracket 46 in a manner similar to bracket 36 on manifolds 24, 26. Each of the manifolds 42, 44 has a plurality of air discharge ports denoted respectively 48, 50 disposed thereon in spaced arrangement.

Each of the discharge ports 48, 50 has disposed therewith and adjacent thereto an upstanding support member 52, 54 respectively. In the present practice, the support members 52, 54 comprise a generally U-shaped rod or bar with the open ends thereof attached to the respective manifolds 42, 44 by any suitable expedient, as, for example, weldment.

The ends of the manifolds 42, 44 disposed for connection to the plenum housing 16 are secured to a generally U-shaped bracket 56. In the present practice, it has been found satisfactory to secure the manifolds to the bracket 56 by weldment.

Figure 8:
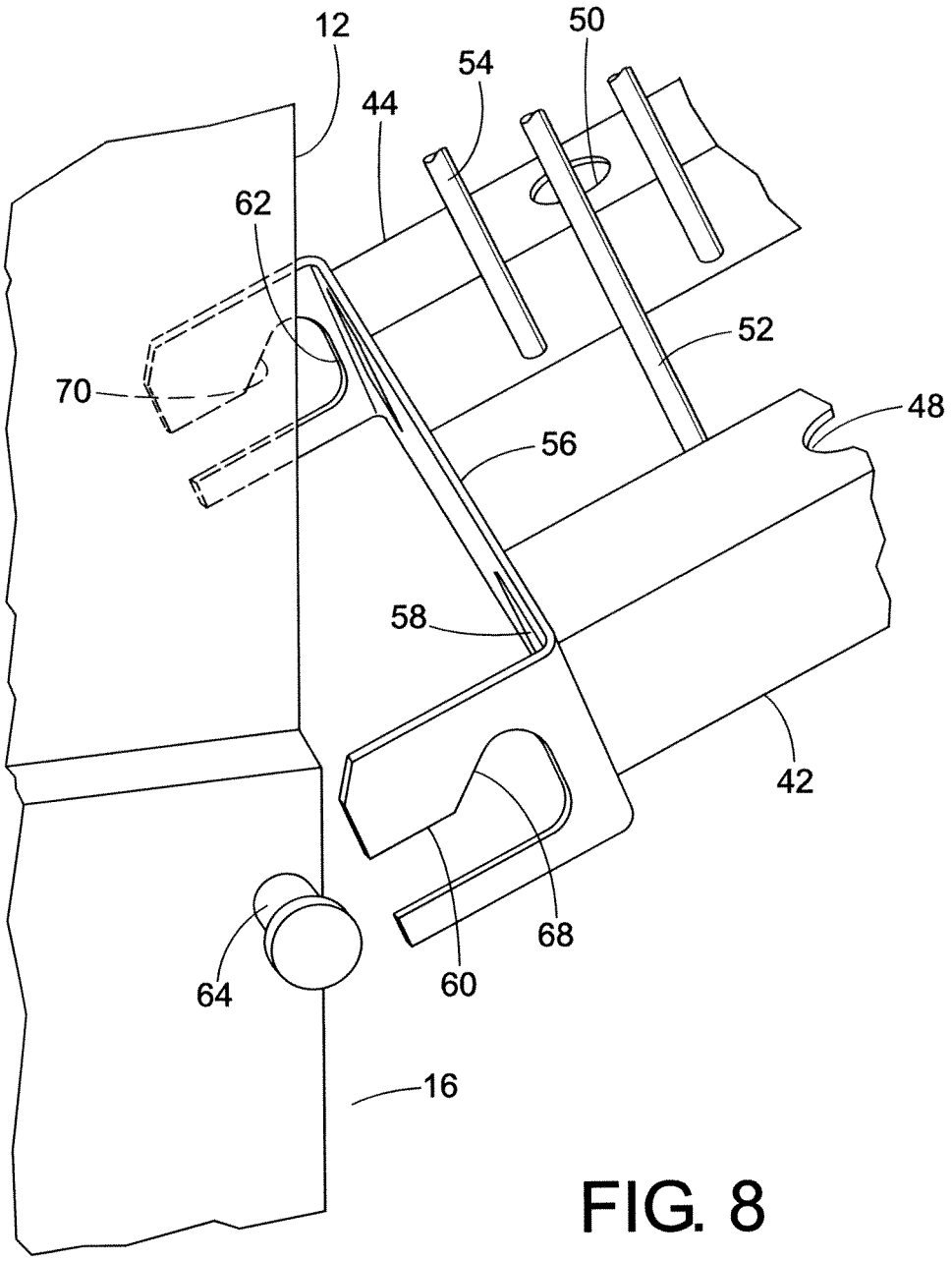
FIG. 8 is an enlarged portion of a perspective view of the dryer of FIG. 1 illustrating the quick-release manifold in a removed position.
Figure 9:
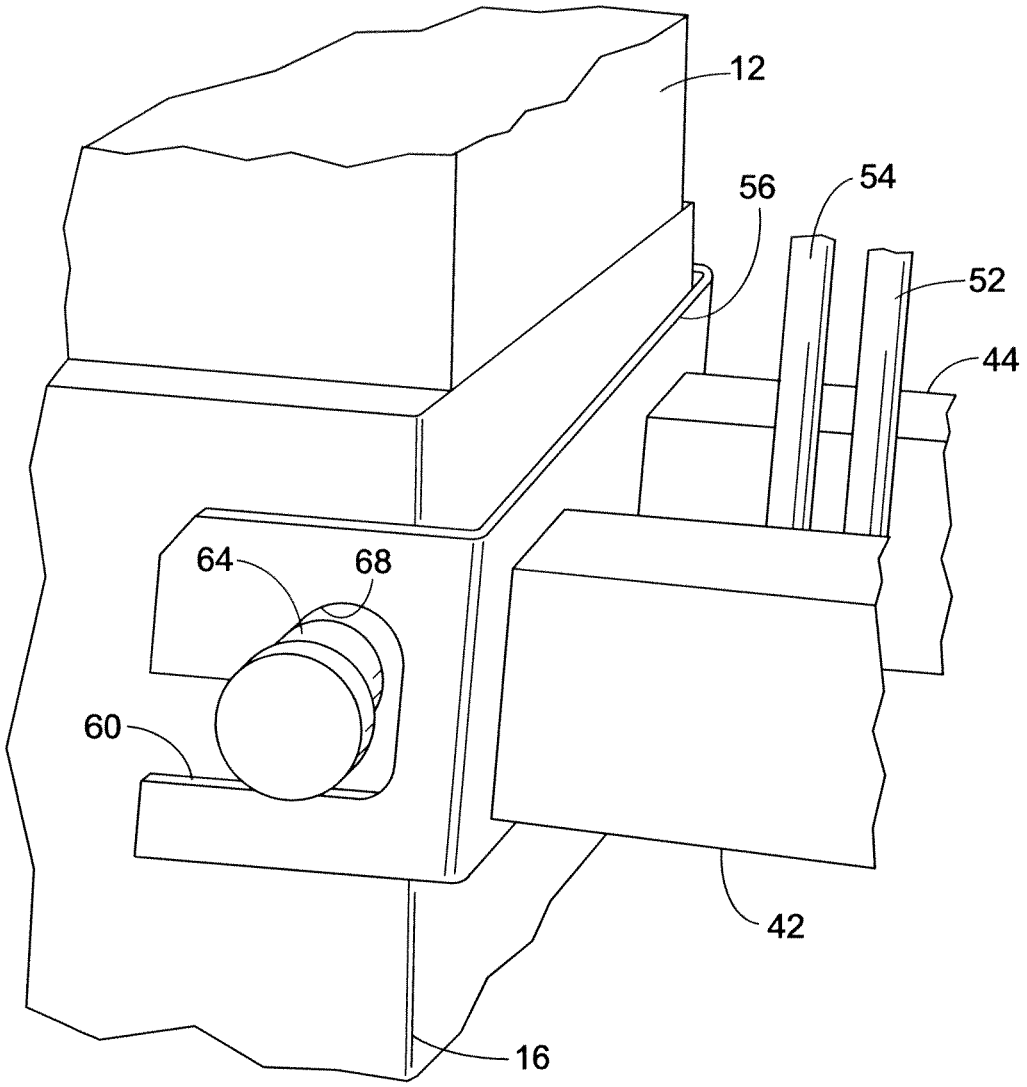
FIG. 9 is a view similar to FIG. 8 illustrating the quick-release manifold in the installed position connected to the plenum housing.

With reference to FIG. 8, the bracket 56 has apertures formed therein to permit plenum discharge air to enter into the ends of the manifolds 42, 44 and one of the such apertures is visible in FIG. 8 and denoted by reference numeral 58 which permits plenum discharge air to enter the manifold 42, it being understood that a similar aperture is formed in bracket 56 for permitting plenum discharge air to enter the manifold 44.

The opposite sides or legs of the bracket 56 each have, respectively, a slot 60, 62 formed therein which slots are configured to openly slide over an attachment lug 64, 66 provided respectively on opposite sides of the plenum housing 16.

Each of the slots 60, 62 in bracket 56 has a camming or inclined surface denoted respectively 68, 70 which camming surface, upon entry of the lug into the slot, is operative by virtue of the weight of the manifolds and bracket acting on the lugs 64, 66 to urge the apertures, such as aperture 58, into contact with the surface of the plenum housing 16 and to thereby secure the apertures, such as aperture 58, into contact with the plenum discharge ports 22. Thus, the user may connect the manifolds 42, 44 to the plenum housings simply by sliding the open ends of the slots 60, 62 over the lugs 64, 66 and lowering the brackets until the camming surfaces 68, 70 engage the lugs 64, 66. Upon releasing the manifold 42, 44, the manifolds are secured in position against the plenum housing to receive plenum discharge air.

Figure 12:
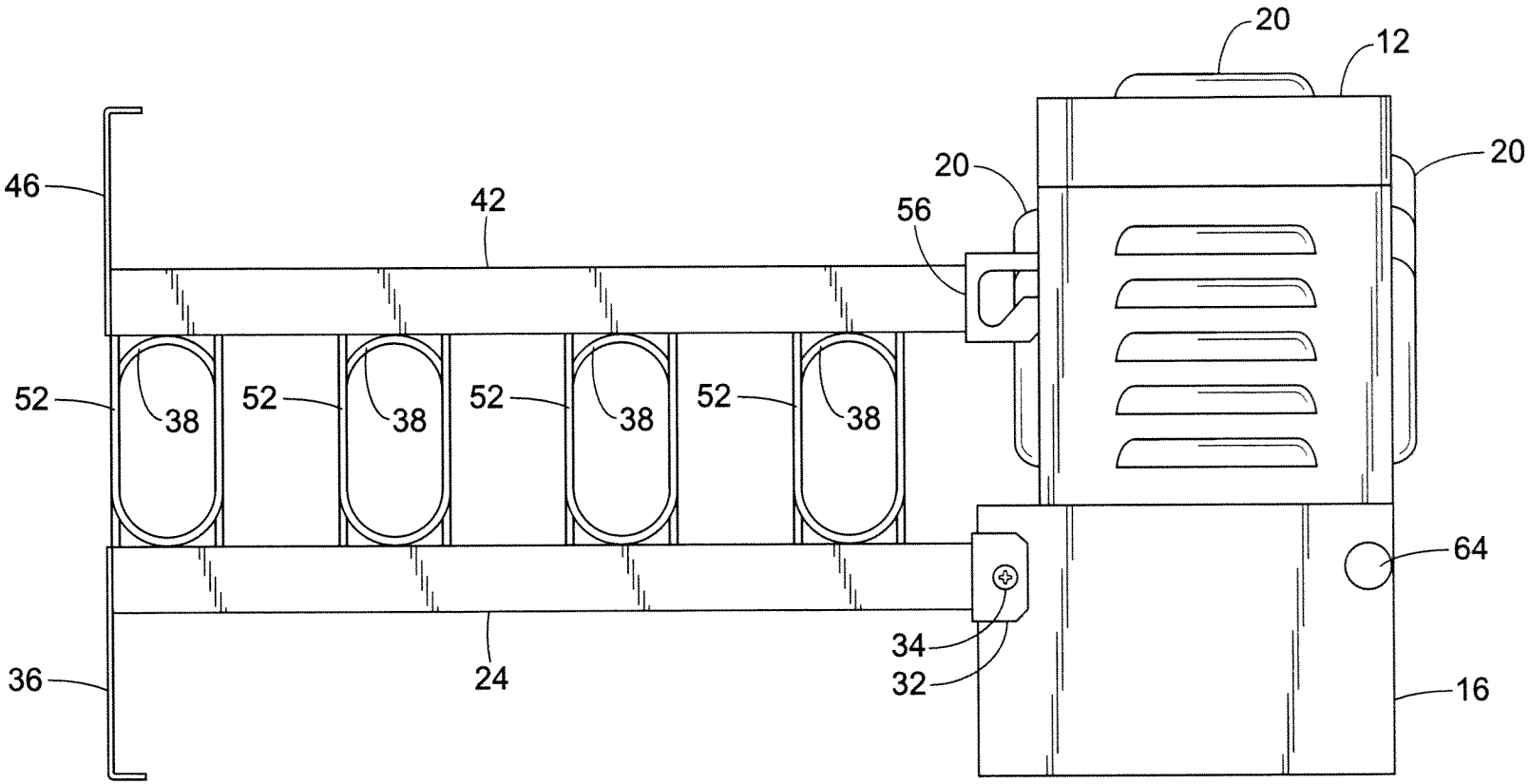

Referring to FIGS. 8 and 12, the dryer of the present disclosure is prepared for transport by the user lifting the inboard ends of the manifolds 42, 44 or the ends adjacent the plenum housing 16 and removing the manifolds from connection to the plenum housing 16 as shown in FIG. 8. The user then inverts the manifolds 42, 44 such that the support members 52, 54 extend downwardly, and places the inverted manifolds 42, 44 onto the manifolds 24, 26 such that the manifolds 42, 44 rest upon the tops of the support members 38, 40, thus, significantly reducing the volume of the dryer. The manifolds are shown in this stacked configuration in FIG. 12 in preparation for transport. The stacked manifolds of FIG. 12 may then be placed in a carry bag or portable container for transport. In the present practice, the dryer of the present disclosure in the configuration shown in FIG. 12 has a combined length of about 73 cm, a height of about 37 cm and a depth of about 26 centimeters and a weight of about eight (8) kilograms. The stacked dryer is therefore, of a size and configuration which may be readily transported by one person when placed in a carry bag or suitable portable enclosure.

The present disclosure describes a portable dryer for multiple articles such as pairs of skates, boots or gloves and the like which is readily carried by one person. The dryer of the present disclosure has a lower end plenum have extending from opposite sides thereof in opposite directions pairs of manifolds with spaced discharge ports and vertical support members associated with each of the discharge ports for drying articles received on the support members. One pair of the manifolds is connected to the plenum in a quick-release manner which enables the user to remove the manifold without any tools, invert the manifold and place it upon the other manifold to significantly reduce the volume of the dryer to enable placement in a carry bag or closure for transport by one person.

The exemplary embodiment has been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. A portable dryer assembly for drying a multiplicity of relatively small articles of apparel comprising:

(a) a housing having disposed therein a blower with a first and second discrete forced air outlet and operable upon connection to a source of power to provide forced air through the outlets;

(b) a first and second air distribution manifold attached to the housing each having an inlet disposed for receiving forced air from one of said first and second forced air outlets and each having a plurality of spaced air discharge ports and an array of spaced elongated article drying support members thereon with one of the support members disposed adjacent each air discharge port, with each of the support members extending outwardly from the surface of the manifold in the direction of air flow from its associated discharge port, wherein one of the first and second manifolds includes a bracket having certain surfaces thereon engaging attachment surfaces provided on the housing and the bracket and the one manifold are releasable therefrom without tools; and, (c) wherein, in preparation for transport and upon release from the blower housing by the user, the one manifold is stacked inverted on the other of the first and second manifold with the elongated article drying support members of the one manifold interdigitated with the elongated article drying support members of the second manifold for minimizing the volume of the assembly for transport.

2. The assembly of claim 1, wherein the attachment surfaces include a lug on the housing and the certain surfaces on the bracket include a slot engaging the lug.

3. The assembly of claim 2, wherein the slot includes a cam surface for urging the manifold against the housing.

4. The assembly defined in claim 1, wherein the elongated drying article support members have an inverted generally U-shaped configuration.

5. The assembly defined in claim 1, wherein the first and second air outlets are disposed to discharge air in opposing directions and the manifolds extend in opposite directions.

6. The assembly of claim 1, wherein the source of forced air includes a heater.

7. The dryer assembly of claim 1 in the stacked configuration has a length of about 73 cm, a height of about 37 cm, a depth of about 26 cm and a weight of about eight (8) kilograms.

* * * * *